US008621808B2

(12) United States Patent
Sharpe et al.

(10) Patent No.: US 8,621,808 B2
(45) Date of Patent: Jan. 7, 2014

(54) STUD FRAME AND FORMWORK PANEL CONSTRUCTED THEREFROM

(76) Inventors: Daniel Philip Sharpe, Shelley (AU); Paul Robert Sharpe, Willeton (AU)

( * ) Notice: Subject to any disclaimer, the term of this patent is extended or adjusted under 35 U.S.C. 154(b) by 0 days.

(21) Appl. No.: 13/123,701

(22) PCT Filed: Oct. 9, 2009

(86) PCT No.: PCT/AU2009/001336

§ 371 (c)(1),
(2), (4) Date: Jun. 15, 2011

(87) PCT Pub. No.: WO2010/040183

PCT Pub. Date: Apr. 15, 2010

(65) Prior Publication Data

US 2011/0265412 A1 Nov. 3, 2011

(30) Foreign Application Priority Data

Oct. 10, 2008 (AU) ..... 2008905253

(51) Int. Cl.
*E04C 2/34* (2006.01)

(52) U.S. Cl.
USPC ..... 52/481.1; 52/429; 52/435; 52/437

(58) Field of Classification Search
USPC ..... 52/426, 481.1, 429, 435, 437
See application file for complete search history.

(56) References Cited

U.S. PATENT DOCUMENTS

| | | | | |
|---|---|---|---|---|
| 5,528,876 | A * | 6/1996 | Lu | 52/654.1 |
| 5,611,182 | A | 3/1997 | Spude | |
| 5,809,726 | A * | 9/1998 | Spude | 52/426 |
| 6,167,671 | B1 * | 1/2001 | Wilson | 52/654.1 |
| 6,295,770 | B1 * | 10/2001 | Sheu et al. | 52/167.1 |
| 6,378,260 | B1 * | 4/2002 | Williamson et al. | 52/426 |
| 6,698,710 | B1 | 3/2004 | Vanderwerf | |
| 7,162,845 | B2 * | 1/2007 | Messiqua | 52/404.1 |
| 7,516,589 | B2 * | 4/2009 | Messiqua et al. | 52/646 |
| 7,748,546 | B2 * | 7/2010 | Konstant | 211/191 |
| 7,752,819 | B2 * | 7/2010 | Zhu | 52/309.12 |
| 7,753,220 | B2 * | 7/2010 | Konstant | 211/191 |
| 8,122,653 | B2 * | 2/2012 | Ellebracht et al. | 52/204.1 |
| 2004/0055237 | A1 * | 3/2004 | Bravinski | 52/426 |
| 2006/0248832 | A1 * | 11/2006 | Shidler | 52/426 |

FOREIGN PATENT DOCUMENTS

| | | |
|---|---|---|
| FR | 2518610 A1 | 6/1983 |
| GB | 852830 A | 11/1960 |
| GB | 2444637 A | 6/2008 |

OTHER PUBLICATIONS

International Search Report dated Nov. 23, 2009 in corresponding International Patent Application No. PCT/AU2009/001336, 3 pages.

* cited by examiner

*Primary Examiner* — Mark Wendell
(74) *Attorney, Agent, or Firm* — Maier & Maier, PLLC

(57) ABSTRACT

A stud frame comprising a first side member (14), a second side member (16) and a plurality of sets of interconnecting members (18) extending from the first 5 side member (14) to the second side member (16). Each set includes a first interconnecting member (34) having a second end (42) connected to the second side member (16) offset longitudinally from a first end (40) thereof in a first direction, a second interconnecting member (36) having a second end (42) connected to the second side member (16) offset longitudinally from the 10 first end (40) thereof in a second opposite direction and a third interconnecting member (38) extending from the first end (40) thereof on one longitudinal side of the first side member (14) to the second end (42) thereof on an opposite longitudinal side of the second side member (16).

15 Claims, 10 Drawing Sheets

STUD FRAME AND FORMWORK PANEL CONSTRUCTED THEREFROM

RELATED APPLICATIONS

This application is the U.S. national stage application which claims priority under 35U.S.C. §371 to International Patent Application No.: PCT/AU2009/001336, filed on Oct. 9, 2009, which claims priority under 35 U.S.C. §119, to Australian Patent Application No.: 2008905253, filed on Oct. 10, 2008, the disclosures of which are incorporated by reference herein their entireties.

FIELD OF THE INVENTION

The present invention relates to a stud frame and a formwork panel unit constructed from the stud frame.

BACKGROUND OF THE INVENTION

Concrete buildings are commonly constructed by erecting formwork panels which are filled with concrete. A known system utilises pairs of fibre cement sheets spaced apart with stud frames. The panels are placed in position forming the walls and other components of the building and the space between the panels is then filled with concrete. The fibre panels remain in place and can be painted or otherwise finished once the joints between the panels have been flushed.

Given the increasing cost of resources, the ability to provide panels of this type which require lower volumes of steel without a reduction in overall strength, is of particular importance. Reducing the volume of steel members joining the pairs of fibre sheets also allows for better flow of concrete between the panels during construction.

The present invention relates to the stud frames used to join the fibre cement sheets in order to provide such a reduction in steel volume.

SUMMARY OF THE INVENTION

According to one aspect of the present invention, there is provided a stud frame comprising:

a first side member;

a second side member; and a plurality of sets of interconnecting members extending from the first side member to the second side member such that when a first side panel is secured to the first side member and a second side panel is secured to the second side member the first and second side members lie in a plane perpendicular to the side panels;

wherein each set includes:

at least one interconnecting member having a second end connected to the second side member offset longitudinally from a first end thereof in a first direction;

at least one interconnecting member having a second end connected to the second side member offset longitudinally from the first end thereof in a second opposite direction; and at least one interconnecting member extending from the first end thereof on one longitudinal side of the first side member to the second end thereof on an opposite longitudinal side of the second side member.

Preferably there is provided a first interconnecting member having a second end connected to the second side member offset longitudinally from a first end thereof in a first direction, a second interconnecting member having a second end connected to the second side member offset longitudinally from the first end thereof in a second opposite direction and a third interconnecting member extending from the first end thereof on one longitudinal side of the first side member to the second end thereof on an opposite longitudinal side of the second side member.

Preferably the first interconnecting member extends between first longitudinal sides of the first and second side members and the second interconnecting member extends between second longitudinal sides of the first and second side members.

Preferably, the first end of the first interconnecting member and the second end of the second interconnecting member lie in the same transverse plane and the second end of the first interconnecting member and the first end of the second interconnecting member lie in the same transverse plane.

In one embodiment, the first and second ends of the third interconnecting member lie in the same transverse plane. The first and second ends of the third interconnecting member preferably lie in the same plane as the first end of the first interconnecting member.

In a preferred embodiment, there is provided first and second sets of interconnecting members of alternating configuration wherein:

the first interconnecting member of the first set extends between first longitudinal sides of the first and second side members and the first interconnecting member of the second set extends between second longitudinal sides of the first and second side members;

the second interconnecting member of the first set extends between second longitudinal sides of the first and second side members and the second interconnecting member of the second set extends between first longitudinal sides of the first and second side members; and the third interconnecting member of the first set extends from the second longitudinal side of the first side member to the first longitudinal side of the second side member and the third interconnecting member of the second set extends from the first longitudinal side of the first side member to the second longitudinal side of the second side member.

Preferably the first and second side members each comprise parallel elongate planar members having transversely extending flanges along longitudinal edges thereof.

According to a second aspect of the present invention, there is provided formwork panel unit comprising:

a plurality of first side members having a first side panel secured thereto ;

a plurality of second side members having a second side panel secured thereto; and a plurality of sets of interconnecting members extending from each of the first side members to a corresponding second side member such that when a first side panel is secured to the first side member and a second side panel is secured to the second side member the first and second side members lie in a plane perpendicular to the side panels;

Preferably there is provided a first interconnecting member having a second end connected to the second side member offset longitudinally from a first end thereof in a first direction, a second interconnecting member having a second end connected to the second side member offset longitudinally from the first end thereof in a second opposite direction and a third interconnecting member extending from the first end thereof on one longitudinal side of the first side member to the second end thereof on an opposite longitudinal side of the second side member.

Preferably the first interconnecting member extends between first longitudinal sides of the first and second side members and the second interconnecting member extends between second longitudinal sides of the first and second side members.

Preferably a first joiner member is provided extending outwardly from a longitudinal side of an endmost side member such that the joiner member extends beyond the edge of the respective side panel. The first joiner member preferably engages with a second joiner member provided on a second longitudinal side of a side member of an adjacent formwork panel unit.

According to a third aspect of the present invention, there is provided a formwork panel unit comprising a first side panel secured to a first side member, a second side panel secured to a second side member and a plurality of interconnecting members extending from the first side member to the second side member, wherein the interconnecting members comprise metallic wires. Preferably the interconnecting members comprise steel wires.

In one embodiment, the interconnecting members are provided on wire frame units provided for connection between the first and second side members. The wire frame unit may comprise first and second wire portions that form the interconnecting members wherein first ends of the first and second wire portions are joined by a first Z-shaped interconnecting portion and second ends of the first and second wire portions are joined by a second Z-shaped interconnecting portion. Further, preferably the second end of the first wire portion is offset longitudinally from the first end in a first direction and the second end of the second wire portion is offset longitudinally from the first end in a second opposite direction. In a further embodiment, intermediate portions of the first and second wire portions include a twined section.

In a further embodiment, first and second elongate wire members are provided having alternate transverse and longitudinal portions such that the longitudinal portions are secured to the first and second side members and the transverse portions comprise the interconnecting members. Preferably the interconnecting members of the first elongate wire member are angularly offset from the interconnecting members of the second elongate wire member.

BRIEF DESCRIPTION OF THE DRAWINGS

The invention will now be described, by way of example, with reference to the following drawings.

DETAILED DESCRIPTION OF PREFERRED EMBODIMENTS

Figure 1:
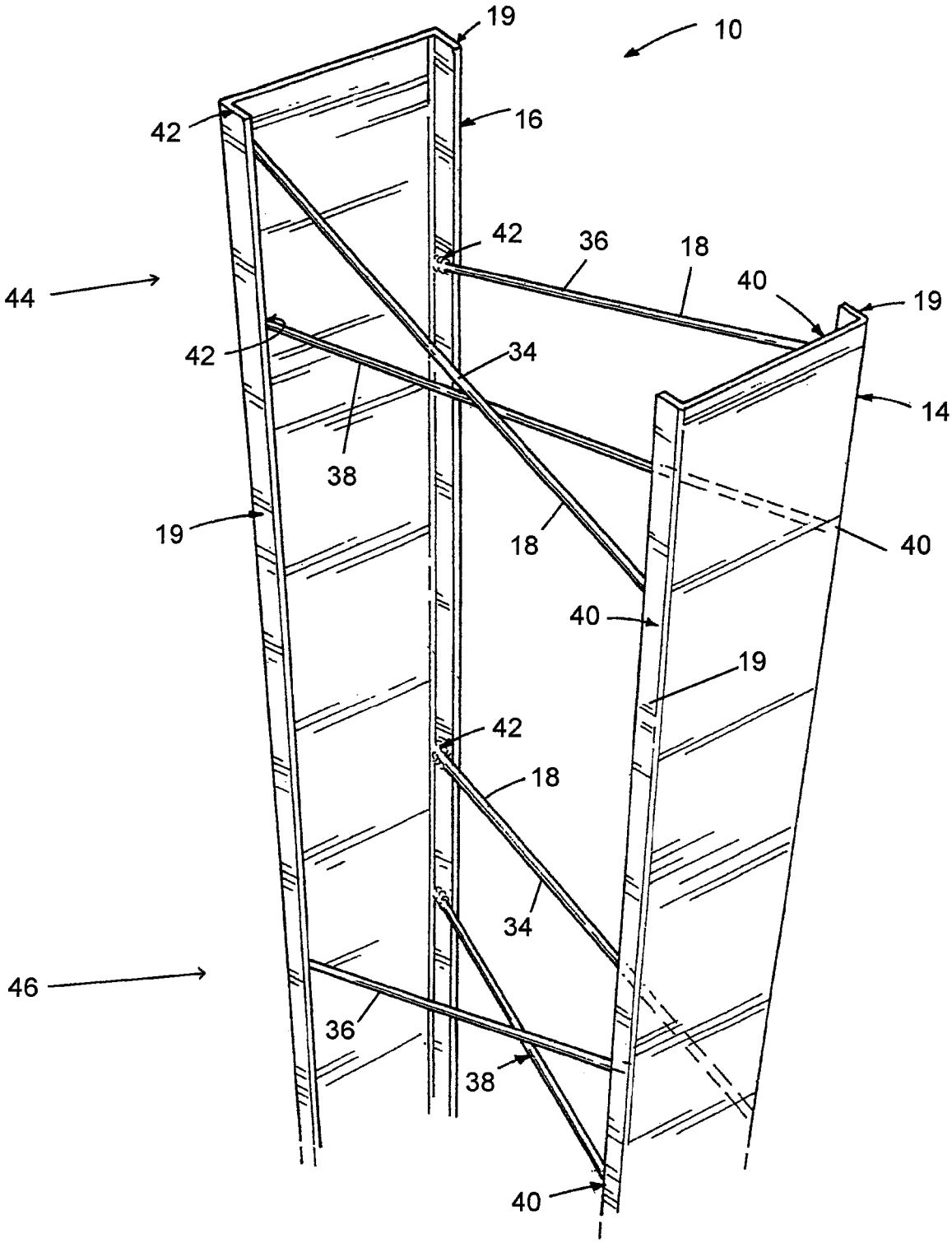
FIG. 1 is perspective view of a stud frame in accordance with the present invention.

Referring to the Figures there is shown a stud frame 10 for constructing a formwork panel unit 12. The stud frame 10 comprises a first side member 14 connected to and spaced apart from a second side member 16 by a plurality of interconnecting members 18. The first side member 14 and the second side member 16 are arranged parallel to each other. Each of the side members comprise an elongate planar member having transversely extending flanges 19 along longitudinal edges thereof. The flanges 19 of the first side member 14 are directed inwardly towards the second side member 16 and the flanges of the second side member 16 are directed inwardly towards the first side member 14.

The formwork panel unit 12 is constructed by securing a first side panel 20 to the first side members 14 of a plurality of stud frames 10 and securing a second side panel 22 to the second side members 16 of said plurality of stud frames 10.

The interconnecting members 18 are angled from the perpendicular to the side members 14 and 16 such that, when connected, a relatively rigid formation connecting between the first and second side members 14 and 16 results.

Figures 2A, 2B:
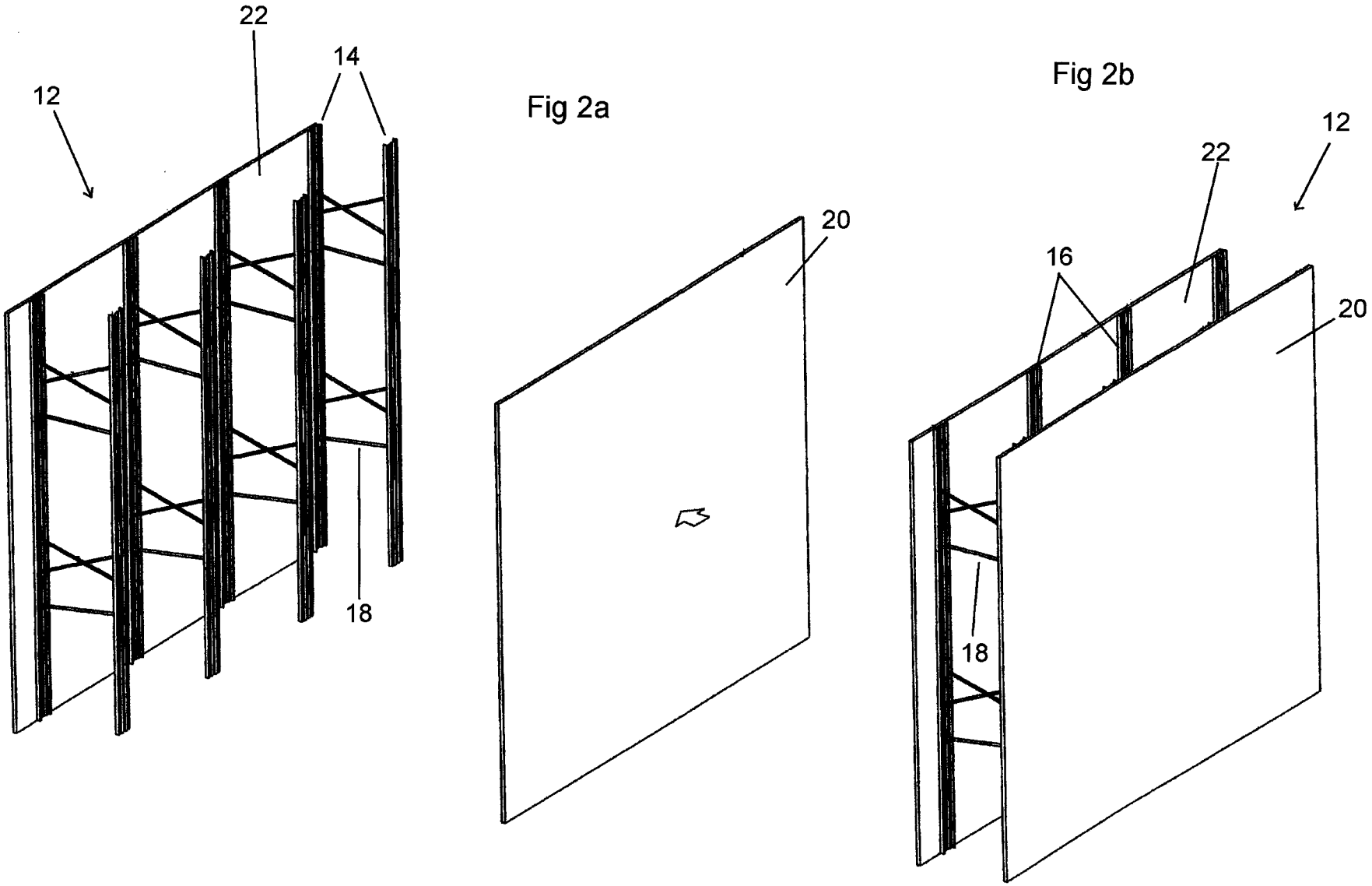
FIG. 2*a* is a perspective view of formation of a formwork panel unit by connection of side panels to a plurality of the stud frames.
FIG. 2*b* is a perspective view of the assembled formwork panel unit.
Figure 3:
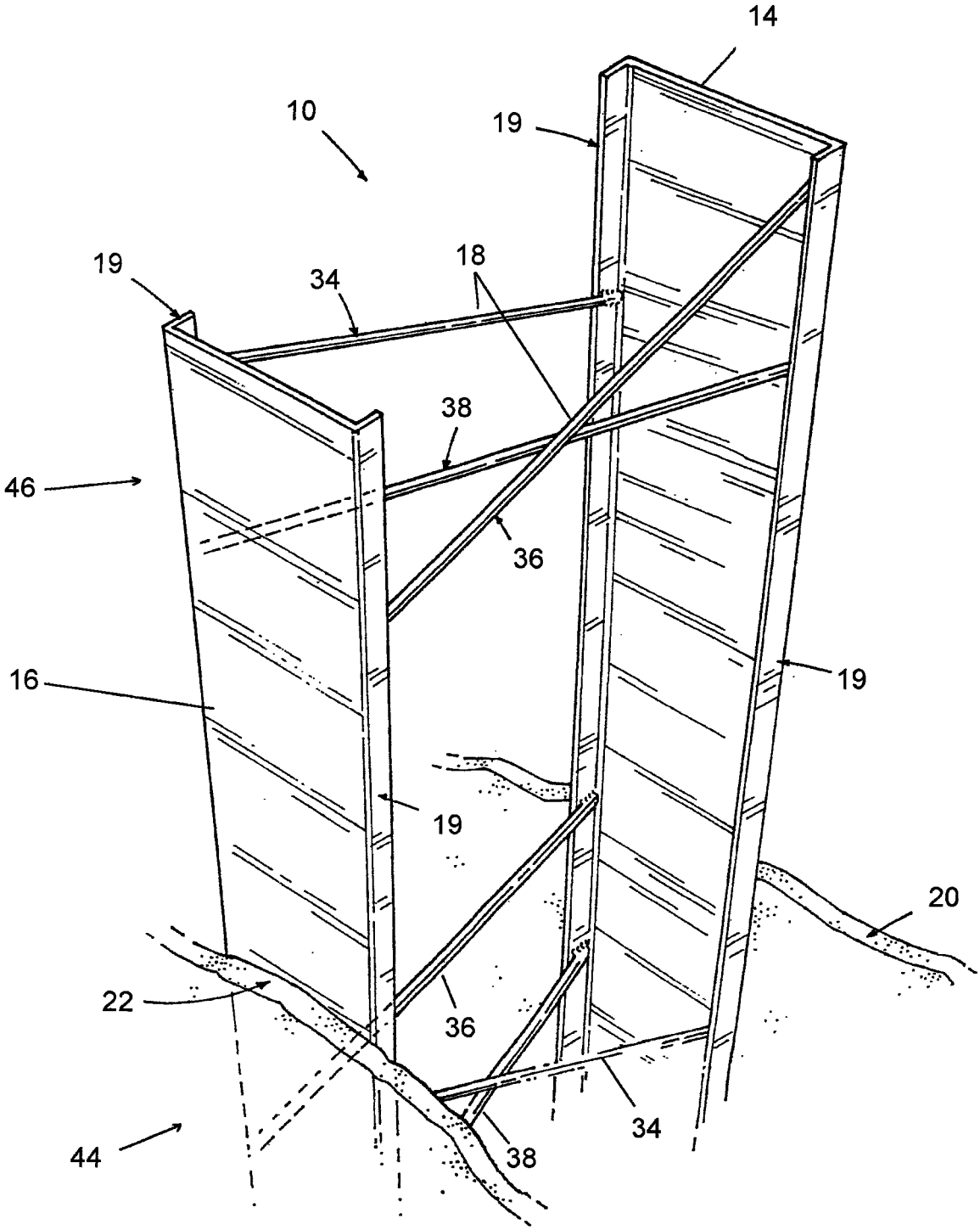
FIG. 3 is a perspective view of a portion the formwork panel unit with parts of the side panels cut away.

In the embodiment shown in FIGS. 1 to 6, the interconnecting members 18 are provided in sets along the length of the first side members 14 and 16 (as can be seen for example in FIG. 2). Each set comprises a first interconnecting member 34, a second interconnecting member 36 and a third interconnecting member 38. The interconnecting members 18 are provided as a wire formed from a suitable metal such as steel. The steel wires are secured to the first and second side members 14 and 16 by an appropriate means, such as welding.

Each interconnecting member 18 includes a first end 40 extending from the first side member 14 and a second end 42 secured to the second side member 16. The second end 42 of the first interconnecting member 34 is connected to the second side member 16 offset longitudinally from the first end 40 in a first direction. The second end 42 of the second interconnecting member 36 is offset longitudinally from the first end 40 in a second opposite direction. The first and second interconnecting members 34 and 36 are provided on opposite longitudinal sides of the side members 14 and 16. That is, the first and second interconnecting members 34 and 36 are located on opposite sides of the side members 14 and 16 and angled in opposite directions to each other.

The third interconnecting member 38 extends from the first end 40 thereof on one longitudinal side of the first side member 14 to an opposite longitudinal side of the second side member 16. That is, the third interconnecting member 38 extends transversely across the side members 14 and 16.

In the embodiment shown, the first end 40 of the first interconnecting member 34 and the second end of the second interconnecting member 36 lie generally in the same transverse plane (that is, a plane being transverse to the longitudinal axes of the side members 14 and 16). The second end 42 of the first interconnecting member 34 and the first end 40 of the second interconnecting member 36 also lie generally in the same transverse plane.

Also, the first and second ends 42 of the third interconnecting member 38 lie in a single transverse plane, being the same transverse plane as the first end 40 of the first interconnecting member 34.

The sets of interconnecting members 18 may be provided in alternating configurations. The embodiment of FIG. 1 shows a first set 44 and a second set 46. In the first set, the first interconnecting member 34 extends between first longitudinal sides of the first and second side members 14 and 16 and the second interconnecting member 36 extends between second longitudinal sides of the first and second side members 14 and 16. The third interconnecting member 38 extends from the second longitudinal side of the first side member 14 to the first longitudinal side of the second side member 16.

In the second set 46, the first interconnecting member 34 extends between second longitudinal sides of the first and second side member 14 and 16 and the second interconnecting member 36 extends between first longitudinal sides of the first and second side members 14 and 16. The third interconnecting member 38 extends from the first longitudinal side of the first side member 14 to the second longitudinal side of the second side member 16.

In use, one or more formwork panel units 12 are secured adjacent each other such that the first side panels 20 of each of the formwork panel units 12 abut to form a first side surface and the second side panels 22 of each of the formwork panel units 12 abut to form a second side surface. Concrete is then poured between the first and second side surfaces and allowed to set. The interconnecting members 18 form reinforcing in the set concrete. The use of interconnecting members in the form of wires has the advantage that the creation of air pockets during pouring is minimized allowing for even distribution of the concrete.

Figure 4:
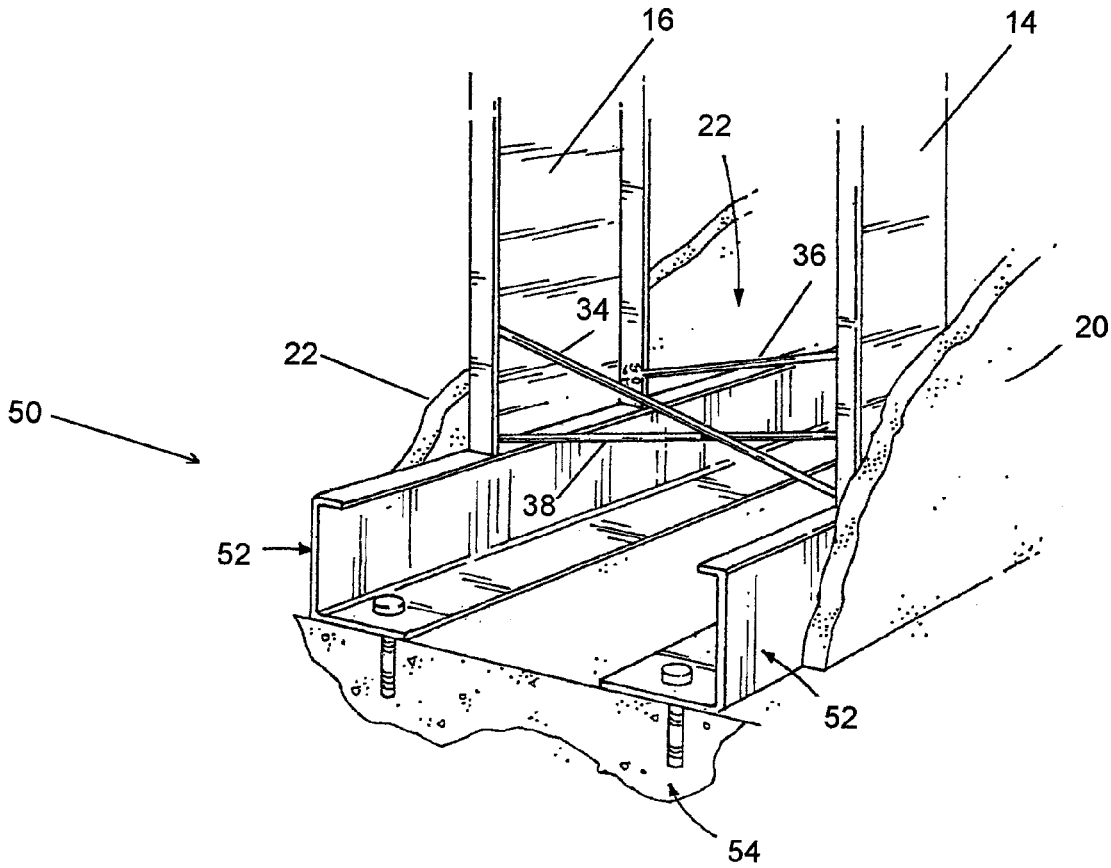
FIG. 4 is a perspective view of the formwork panel unit of FIG. 2 secured to a concrete slab.

FIG. 4 shows a support track 50 for use with the stud frame 10 of the present invention. The support frame 50 comprises a pair of elongate members 52 arranged parallel to each other and secured to a concrete slab 54. The elongate members 52 comprise lengths of C-channel secured such that the distance between the outer edges of the C-channels is generally the distance between the first and second side panels 20 and 22. The formwork panel units 12 can therefore be placed onto the support track 50 such that the support track 50 is received between the first and second side panels 20 and 22 as shown.

Figure 5:
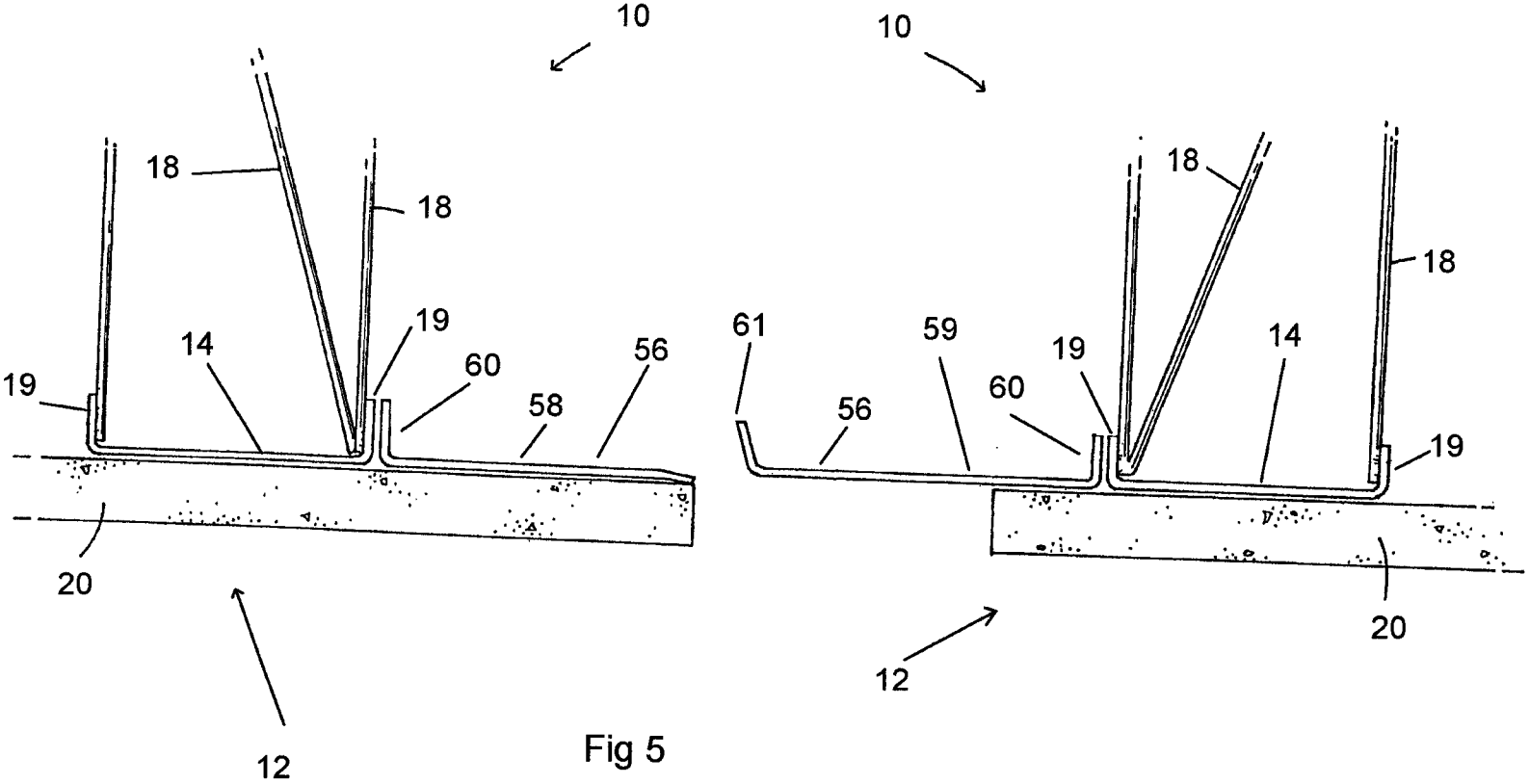
FIG. 5 is an end view of connection of adjacent formwork panel units.
Figure 6:
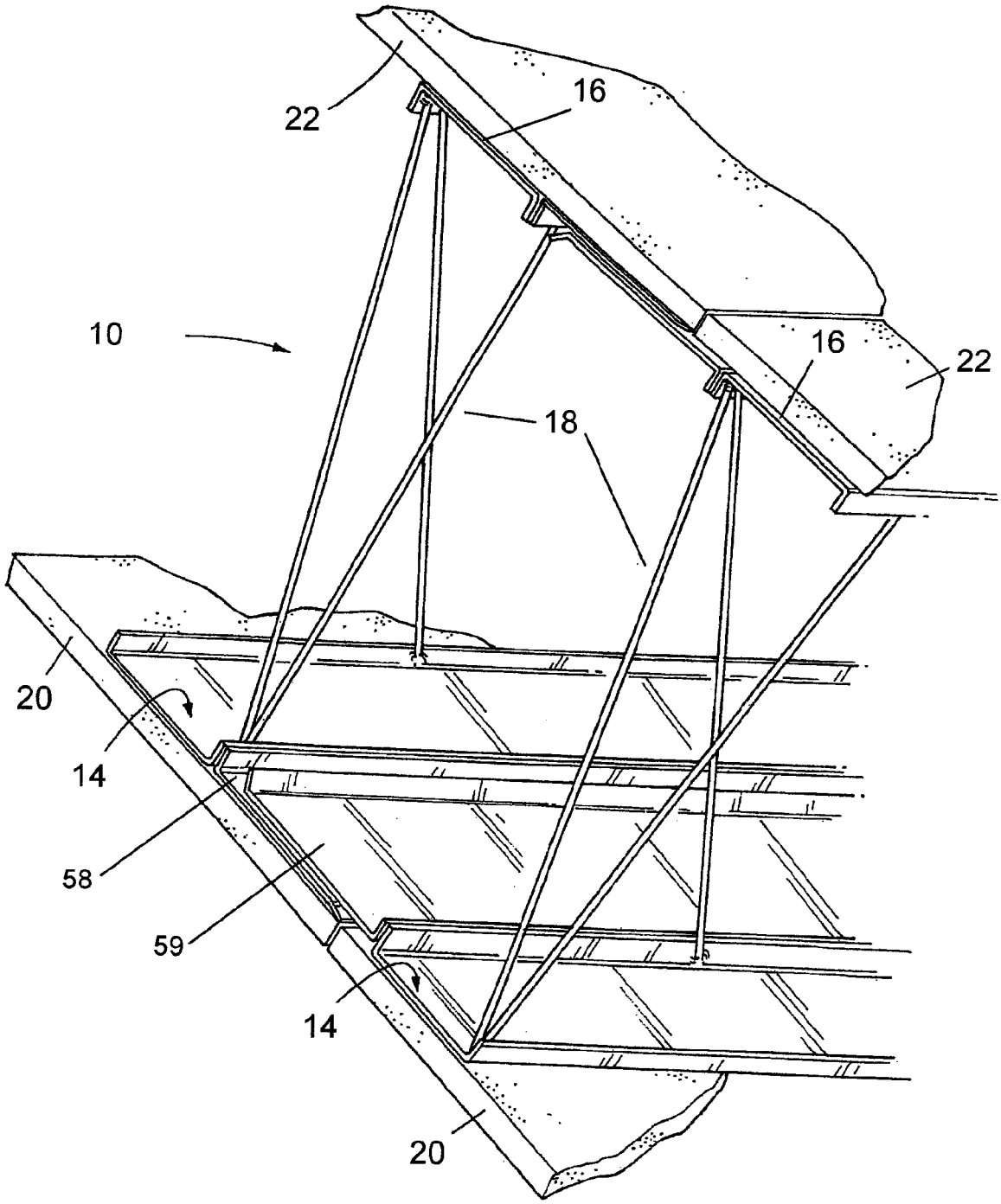
FIG. 6 is an upper perspective view of connected formwork panel units.

FIG. 5 shows a pair of adjacent formwork panel units 12 each having a joiner member 56. A first joiner member 58 is provided connected to a first longitudinal side of an endmost side member 14 or 16 and a second joiner member 59 is provided connected to a second longitudinal side of an endmost side member 14 or 16 of the adjacent formwork panel unit 12.

The first joiner member 59 extends outwardly from the side member 14 or 16 generally parallel to the side member. The first joiner member 59 includes a turned up edge 60 that is connected to the flange 19 of the side member 14 by appropriate means, such as welding. The second joiner member 58 extends outwardly from the side member 14 or 16 generally parallel thereto and also includes an upturned edge secured to the flange 19 of the side member by welding. The first joiner member 59 extends beyond the edge of the side panel 20 and includes an upturned distal edge 61. When the formwork panel units 12 are placed adjacent each other, the first joiner member 59 engages with the second joiner member 58. The engagement of the joiner members 56 thereby seal across the join of adjacent side panels 20.

Figure 7:
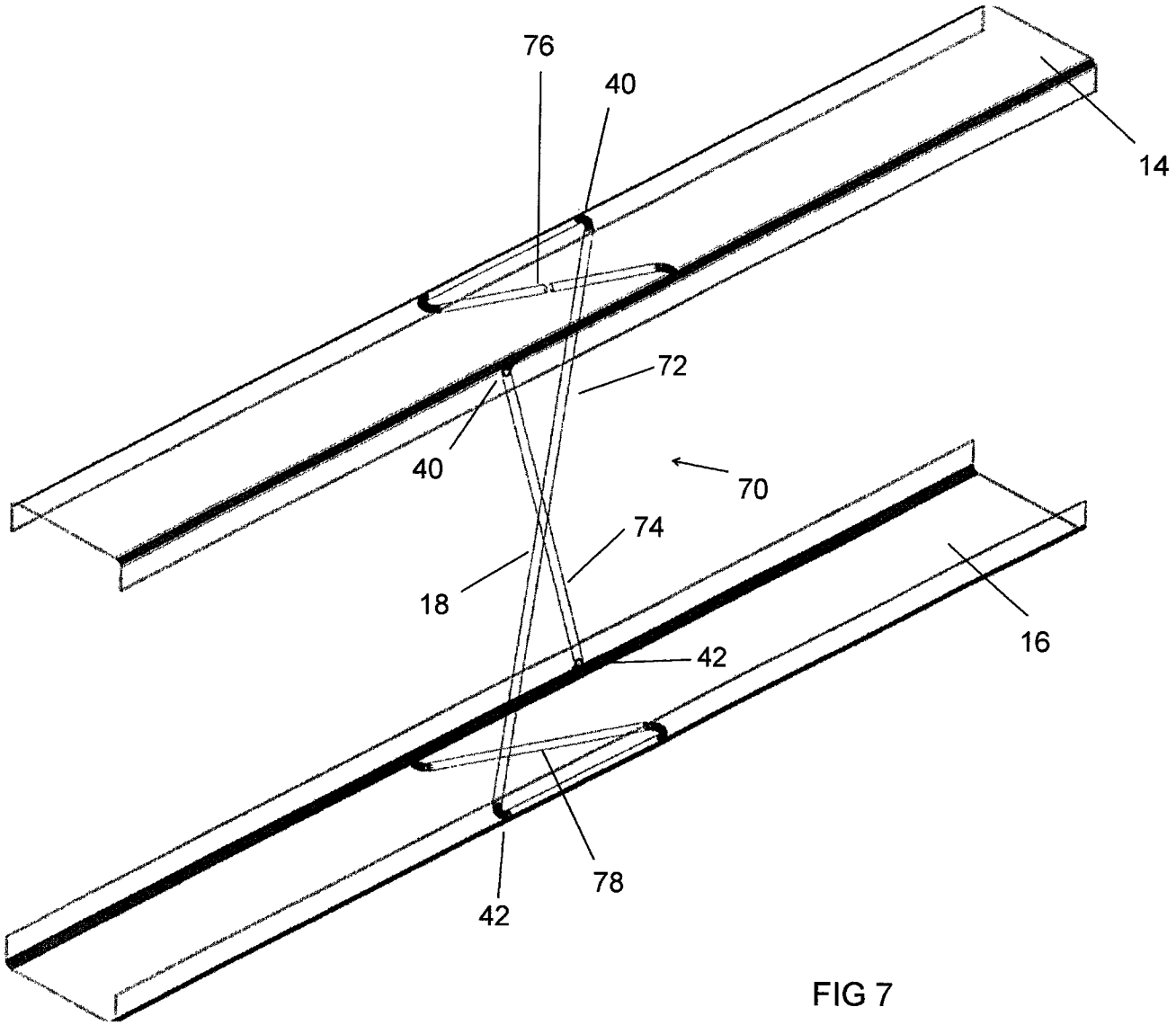
FIG. 7 is a perspective view of a first alternate configuration of interconnecting members for use in a stud frame in accordance with the third aspect of the present invention.
Figure 8:
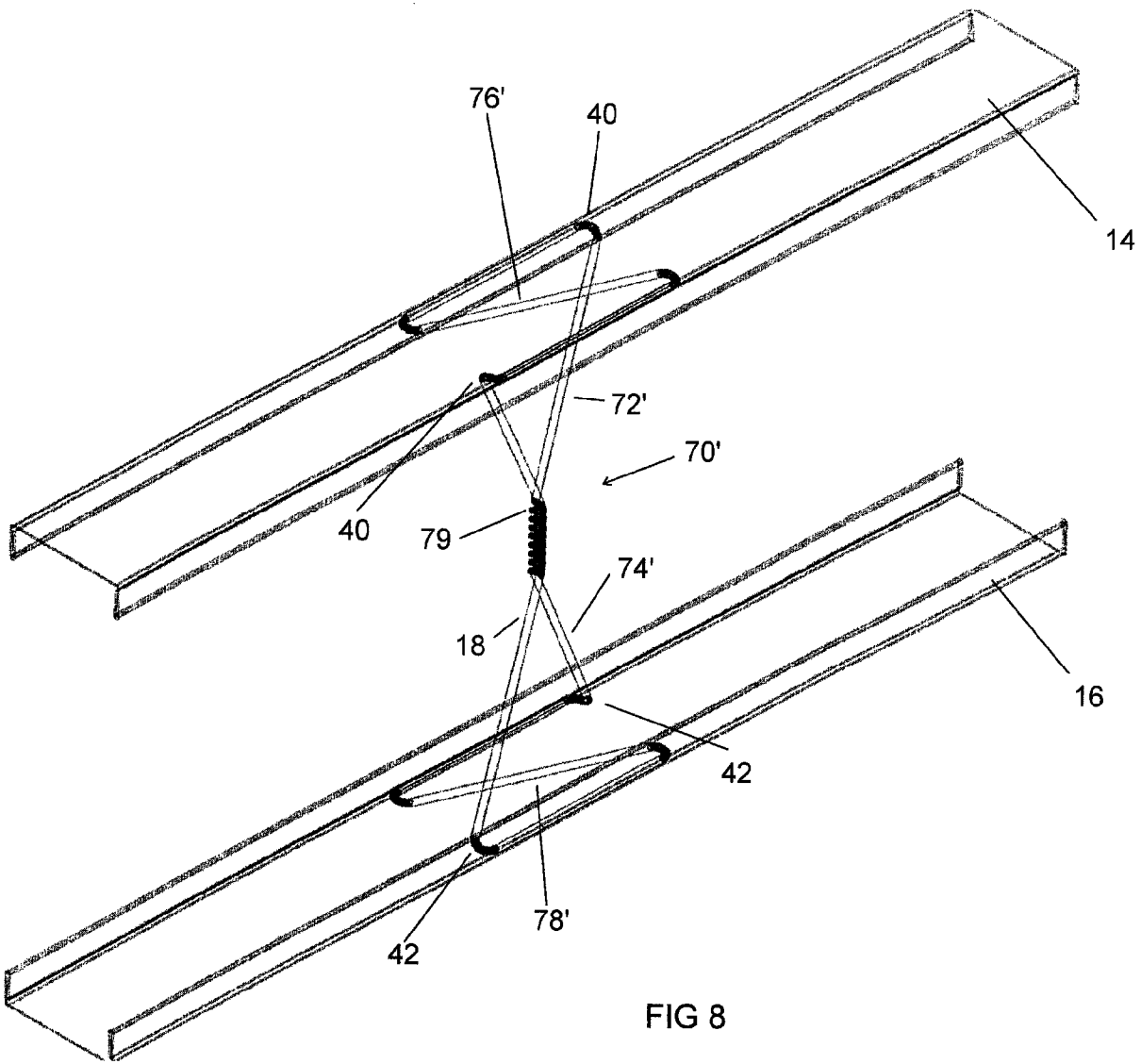
FIG. 8 a perspective view of a second alternate embodiment of interconnecting members for use in a stud frame in accordance with the third aspect of the present invention.
Figure 9:
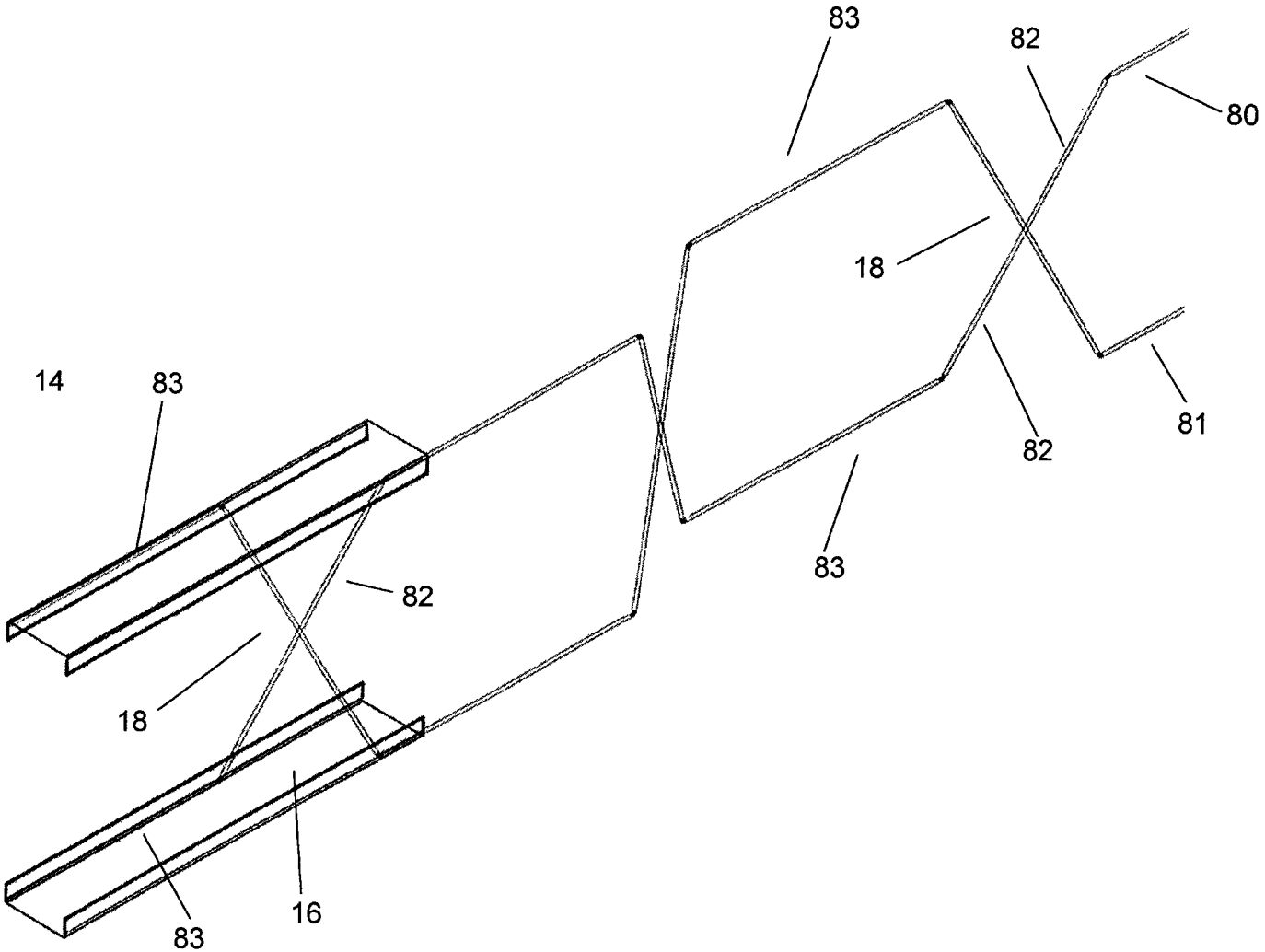
FIG. 9 is a perspective view of a third alternate embodiment of interconnecting members in accordance with the third aspect of the present invention partially fitted into side members of the stud frame.

FIGS. 7 to 9 show alternate embodiments of interconnecting members 18 according to the third aspect of the present invention.

In the embodiment of FIG. 7, wire frame units 70 are provided for connection between the first and second side members 14 and 16. Each wire frame unit 70 includes a first wire portion 72 and a second wire portion 74 that form the interconnecting members 18 to join the first and second side members 14 and 16. The first wire portion 72 in use joins between a first longitudinal side of the first side member 14 and a second longitudinal side of the second side member 16 and the second wire portion 74 in use joins between a second longitudinal side of the first side member 14 and a first longitudinal side of the second side member 16. The second end 42 of the first wire portion 72 is connected to the second side member 16 offset longitudinally from the first end 40 in a first direction and the second end 42 of the second wire portion 74 is offset longitudinally from the first end 40 in a second opposite direction. The first ends 40 of the first and second wire portions 72 and 74 are joined by a first Z-shaped interconnecting portion 76 that rests against the first side member 14 in use and second ends 42 of the first and second wire portions 72 and 74 are joined by a second Z-shaped interconnecting portion 78 that rests against the second side member 16 in use.

The embodiment of FIG. 8 also comprises a wire frame unit 70'. The wire frame unit 70' of FIG. 8 is similar to that of FIG. 7 and like reference numerals are used to denote like parts. Intermediate portions of the first and second wire portions 72' and 74' in this embodiment are twisted around each other to form a twined section 79.

Figure 10:
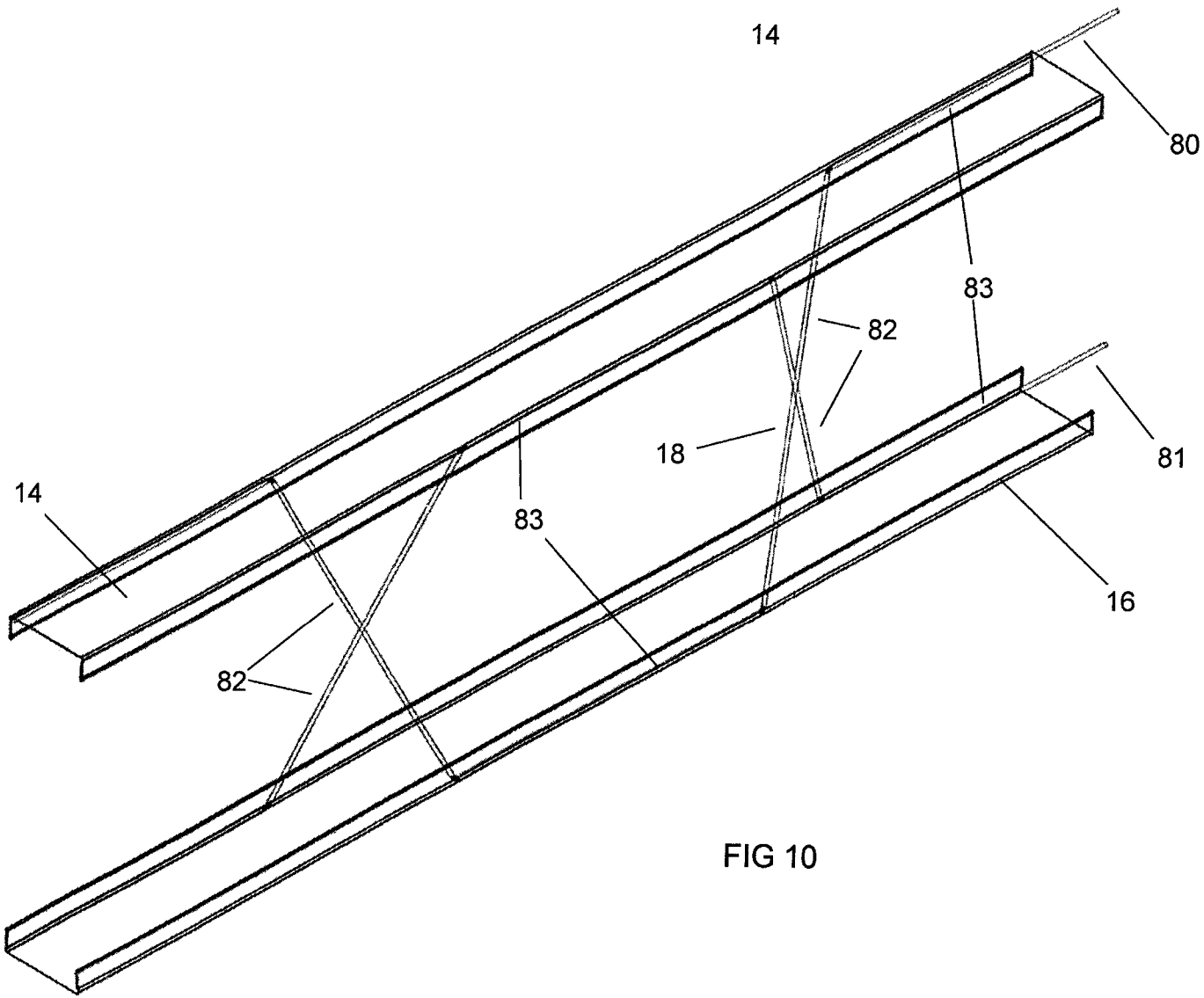
FIG. 10 is a perspective view of the interconnecting members of FIG. 9 fitted into the side members.

In the embodiment of FIGS. 9 and 10, the interconnecting members 18 are provided on first and second elongate wire members 80 and 81. Each elongate wire member 80 and 81 comprises an elongate wire having a generally square wave shape such that the elongate wire members 80 and 81 comprise alternately transverse portions 82 and longitudinal portions 83. The first elongate wire member 80 is arranged in use such that the longitudinal portions 83 are secured to the first and second side members 14 and 16 on opposite longitudinal sides thereof. The second elongate wire member 81 is also arranged such that the longitudinal portions 83 are secured to opposite longitudinal sides of the first and second side members 14 and 16. The transverse portions 82 and 83 of the first and second elongate wire members 80 and 81 therefore form the connecting members with the interconnecting members 18 with the interconnecting members 18 on the first elongate wire member 80 being angularly offset from the interconnecting members 18 of the second elongate wire member 81.

It would be readily apparent to persons skilled in the relevant arts that various modifications and improvements may be made to the foregoing embodiments, in addition to those already described, without departing from the basic inventive concepts of the present invention.

The invention claimed is:

1. A stud frame comprising:

a first side member;

a second side member; and a plurality of sets of interconnecting members extending from the first side member to the second side member such that when a first side panel is secured to the first side member and a second side panel is secured to the second side member the first and second side members lie in a plane perpendicular to the side panels;

wherein each set further comprises:

a first interconnecting member having a second end connected to the second side member offset longitudinally from a first end thereof in a first direction;

a second interconnecting member having a second end connected to the second side member offset longitudinally from the first end thereof in a second opposite direction; and a third interconnecting member extending from the first end thereof on one longitudinal side of the first side member to the second end thereof on an opposite longitudinal side of the second side member;

wherein the first interconnecting member extends between first longitudinal sides of the first and second side members and the second interconnecting member extends between second longitudinal sides of the first and second side members.

2. A stud frame in accordance with claim 1, wherein the first end of the first interconnecting member and the second end of the second interconnecting member lie in the same transverse plane and the second end of the first interconnecting member and the first end of the second interconnecting member lie in the same transverse plane.

3. A stud frame in accordance with claim 2, wherein the first and second ends of the third interconnecting member lie in the same transverse plane.

4. A stud frame in accordance with claim 3, wherein the first and second ends of the third interconnecting member lie in the same plane as the first end of the first interconnecting member.

5. A stud frame in accordance with claim 1, wherein there is provided first and second sets of interconnecting members of alternating configuration.

6. A stud frame in accordance with claim 5, wherein:

the first interconnecting member of the first set extends between first longitudinal sides of the first and second side members and the first interconnecting member of the second set extends between second longitudinal sides of the first and second side members;

the second interconnecting member of the first set extends between second longitudinal sides of the first and second side members and the second interconnecting member of the second set extends between first longitudinal sides of the first and second side members; and the third interconnecting member of the first set extends from the second longitudinal side of the first side member to the first longitudinal side of the second side member and the third interconnecting member of the second set extends from the first longitudinal side of the first side member to the second longitudinal side of the second side member.

7. A stud frame in accordance with claim 1, wherein the first and second side members each comprise parallel elongate planar members having transversely extending flanges along longitudinal edges thereof.

8. A stud frame in accordance with claim 1, wherein the interconnecting members comprise metallic wire.

9. A stud frame in accordance with claim 8, wherein the interconnecting members comprise steel wire.

10. A stud frame in accordance with claim 9, wherein the steel wires are secured to the first and second side members by welding.

11. A formwork panel unit comprising:

a plurality of first side members having a first side panel secured thereto;

a plurality of second side members having a second side panel secured thereto; and a plurality of sets of interconnecting members extending from each of the first side members to a corresponding second side member such that when a first side panel is secured to the first side member and a second side panel is secured to the second side member the first and second side members lie in a plane perpendicular to the side panels;

wherein each set includes at least one interconnecting member having a second end connected to the second side member offset longitudinally from a first end thereof in a first direction, at least one interconnecting member having a second end connected to the second side member offset longitudinally from the first end thereof in a second opposite direction and at least one interconnecting member extending from the first end thereof on one longitudinal side of the first side member to the second end thereof on an opposite longitudinal side of the second side member.

12. A formwork panel unit in accordance with claim 11, wherein there is provided a first interconnecting member having a second end connected to the second side member offset longitudinally from a first end thereof in a first direction, a second interconnecting member having a second end connected to the second side member offset longitudinally from the first end thereof in a second opposite direction and a third interconnecting member extending from the first end thereof on one longitudinal side of the first side member to the second end thereof on an opposite longitudinal side of the second side member.

13. A formwork panel unit in accordance with claim 12, wherein the first interconnecting member extends between first longitudinal sides of the first and second side members and the second interconnecting member extends between second longitudinal sides of the first and second side members.

14. A formwork panel unit in accordance with claim 13, wherein there is provided a first joiner member extending outwardly from a longitudinal side of an endmost side member such that the joiner member extends beyond the edge of the respective side panel.

15. A stud frame in accordance with claim 14, wherein the first joiner member engages with a second joiner member provided on a second longitudinal side of a side member of an adjacent formwork panel unit.

* * * * *